US011530894B2

(12) United States Patent
Dechant et al.

(10) Patent No.: US 11,530,894 B2
(45) Date of Patent: Dec. 20, 2022

(54) PISTOL HAVING A RIGID BARREL, IN PARTICULAR TRAINING WEAPON

(71) Applicant: Glock Technology GmbH, Ferlach (AT)

(72) Inventors: Friedrich Dechant, Hollabrunn (AT); Thomas Stern, Neubau (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 225 days.

(21) Appl. No.: 16/905,642

(22) Filed: Jun. 18, 2020

(65) Prior Publication Data

US 2021/0003362 A1 Jan. 7, 2021

(30) Foreign Application Priority Data

Jun. 19, 2019 (EP) ..... 19181261

(51) Int. Cl.
*F41A 33/00* (2006.01)

(52) U.S. Cl.
CPC ..... *F41A 33/00* (2013.01)

(58) Field of Classification Search
CPC ..... F41A 33/00; F41A 21/484; F41A 21/488; F41A 11/00
USPC ..... 434/16
See application file for complete search history.

(56) References Cited

U.S. PATENT DOCUMENTS

| | | | | | |
|---|---|---|---|---|---|
| 2,503,272 | A * | 4/1950 | Jobert | F41A 11/00 | 89/191.01 |
| 3,728,939 | A * | 4/1973 | Wilhelm | F41A 21/488 | 89/196 |
| 4,594,935 | A * | 6/1986 | Smith | F41A 21/484 | 89/138 |
| 5,076,139 | A * | 12/1991 | Hiett | F41A 3/86 | 89/198 |
| 5,678,343 | A | 10/1997 | Menges | | |
| 10,209,024 | B2 | 2/2019 | Kroyer | | |
| 2010/0269394 | A1* | 10/2010 | Ketchum | F41A 11/00 | 42/108 |

(Continued)

FOREIGN PATENT DOCUMENTS

| | | | |
|---|---|---|---|
| DE | 19513594 | A1 | 10/1996 |
| EP | 3190373 | A1 | 7/2017 |

(Continued)

*Primary Examiner* — Robert P Bullington
*Assistant Examiner* — Stephen Alvesteffer
(74) *Attorney, Agent, or Firm* — Raven Patents, LLC; Anton E. Skaugset

(57) ABSTRACT

A training pistol having a rigid barrel and operating with a conventional blowback system, including a frame, a slide and a barrel, including a slide stop device, a firing pin assembly and preferably including a slide lock which can be moved into a disassembly position in which it releases the movement of the slide toward the front. This release can only be achieved if there is no magazine in the magazine well of the frame and the slide is stopped. The barrel is fastened in the frame by a locking device that can be brought into a release position in which it releases the barrel. Additionally an unlocking gap is provided between the barrel and the slide, and when the gap is overcome, after the slide lock has moved into the disassembly position, an unlocking ramp provided on the slide forces the locking device into the release position.

10 Claims, 11 Drawing Sheets

(56) References Cited

U.S. PATENT DOCUMENTS

| | | | | |
|---|---|---|---|---|
| 2017/0191784 | A1* | 7/2017 | Kroyer | F41A 21/26 |
| 2018/0245868 | A1* | 8/2018 | Dechant | F41A 3/64 |

FOREIGN PATENT DOCUMENTS

| | | | |
|---|---|---|---|
| EP | 3179193 | B1 | 6/2018 |
| EP | 3367040 | A1 | 8/2018 |
| GB | 17029 | A | 4/1916 |

* cited by examiner

PISTOL HAVING A RIGID BARREL, IN PARTICULAR TRAINING WEAPON

TECHNICAL FIELD

The invention relates to a pistol having a rigid barrel and operating with a conventional blowback system, in particular a training weapon which, in the context of this invention, is also synonymously called a practice weapon, practice pistol or training pistol.

BACKGROUND

A wide range of demands, some of which are contradictory, are placed on training weapons. Their appearance should therefore correspond as closely as possible to the real weapon in terms of shape and haptics in order to allow training that is as similar as possible to reality; however, the difference from the real weapon must be immediately recognizable under all circumstances in order to reliably avoid confusion. In terms of mass and location of the center of gravity, the weapon, equipped with practice ammunition, should be as similar as possible to the real weapon; however, this is impossible due to the differences in ammunition, and therefore compromises have to be made. Due to the relatively low energy when a practice shot is fired, it is also not possible to move a conventional blowback system, a tilting barrel locking system or a rotating barrel locking system, and therefore compromises have to be made in this respect, too. This leads to the problem that such compromises in the prior art can cause the training weapon to deviate from the real weapon that it is intended to represent; there may be significant differences from the real weapon in particular when disassembling (and, of course, also when assembling; reference will not be made specifically thereto in future, unless assembly itself is under discussion). Since disassembly of a firearm be practiced, this is a disadvantage that cannot be avoided in the prior art.

A rotating-barrel pistol is known, inter alia, which, with reference to EP3179193 B1, EP3367040 A1 and EP19174261.8 (not yet published), serves as an example of a "real" weapon and in which disassembly is carried out as follows: After the last shot has been fired or, alternatively, after the slide has been pulled back by hand, said slide remains close to its rearmost position, held by the slide holder or slide stop lever. The magazine must be removed at this time. At the rearmost end of the slide, a cover plate which is connected to the firing pin assembly or belongs thereto is then rotated and pulled backward out of the slide either in part or entirely, depending on the design of the pistol.

This relaxes the firing pin assembly. Only then can a slide lock be twisted into the disassembly position. The slide stop lever is then brought into the release position and the slide can be pulled forward with the barrel via the slide lock in the disassembly position; the pistol is disassembled. The actual function and the associated structure (such as rotating barrel, blowback system and/or form-locking system) are not significant for this weapon in connection with the production of a training pistol.

It is the aim and object of the invention to present an alternative disassembly concept for pistols having a rigid barrel and blowback system, in particular to produce a training weapon for the above-mentioned pistol having a rotating barrel, in which the disassembly process for the practice weapon corresponds as far as possible to that of the "real" weapon, without impairing the functionality as a training weapon when shooting.

SUMMARY

These aims are achieved by a pistol having the features specified in the characterizing part of claim 1. In other words, the pistol according to the invention has a barrel that is fixed in the frame and a force-fit blowback system. The barrel is arranged in a locking block, which ensures the connection to the frame, and is thus fixed to the housing, i.e. is rigid relative to the frame.

In the case of a training pistol, it may be necessary to reduce the mass of the slide in order to be functional with a correspondingly reduced propellant gas energy. This can be achieved in particular by one or more plastics parts on or within the slide, in regions that are not mechanically stressed during firing.

In the case of the above-mentioned rotating-barrel pistol, the slide can be released by a slide lock by separating the trigger mechanism and the firing pin assembly, after which the slide, together with the rotating barrel, can be pulled forward. In order to align the disassembly process of a pistol having a rigid barrel or a training pistol with a weapon having a rotating barrel according to the mode of operation as in the preamble of claim 1, the axial fixation of the fixed or rigid barrel during the forward movement of the slide in the course of disassembly must be removed. According to the invention, this can be carried out without conscious intervention by the operator, i.e. intuitively, by pushing forward, since an unlocking gap is provided between the barrel or cartridge chamber and the slide, and when an unlocking ramp provided on the slide, also called an unlocking cam, overcomes said unlocking gap, this unlocking can be achieved by automatic actuation of a locking device. In this way, a separately operated mechanical release device for the barrel and/or slide can be avoided, as a result of which the design can be very compact and have few components.

BRIEF DESCRIPTION OF THE DRAWINGS

The invention is explained in more detail in the following with reference to the drawings, in which.

For the sake of improved representation, the plastics parts in the slide are hidden in FIGS. 5-10 and FIGS. 13-19.

DETAILED DESCRIPTION

Figure 1:
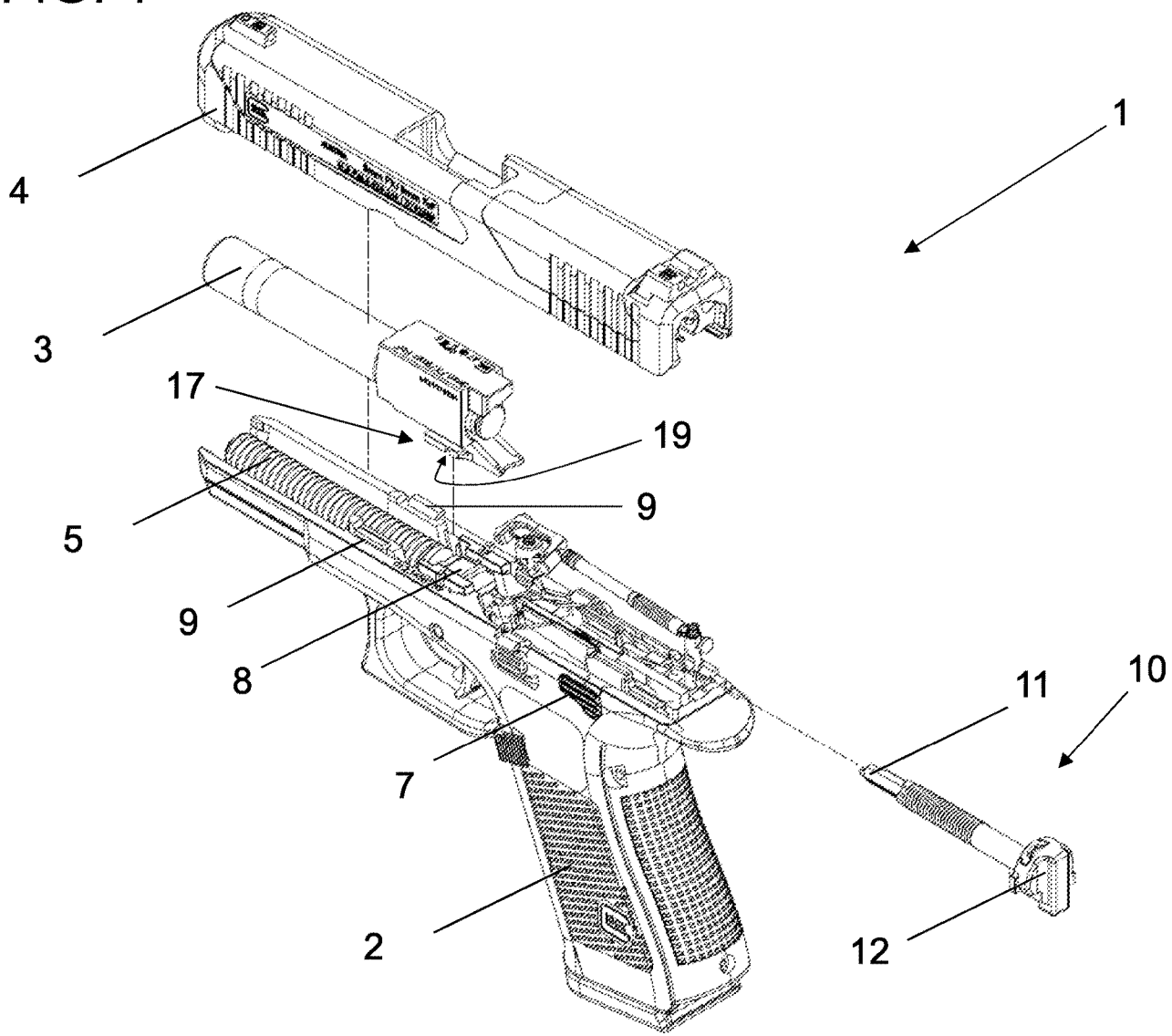
FIG. 1 is a partial exploded view of a training pistol according to the invention.

FIG. 1 shows a pistol 1 in a partially disassembled state in a kind of exploded view. A frame 2, a barrel 3, a slide 4, a recoil spring assembly 5, consisting of the actual spring and a carrier, and a firing pin assembly 10, which comprises a firing pin 11 and a cover plate 12, are shown. On the frame 2, a slide lock 7, a locking block 8 and frame rails 9 are particularly emphasized; the barrel 3 has a barrel base 17 for mounting in the frame 2. A groove-shaped locking device seat 19 on the underside of the barrel base 17 can also be seen. Other components, specifically belonging to the trigger mechanism and its components, are shown by way of example, but without reference signs, since they are not essential for understanding the invention.

Figure 2:
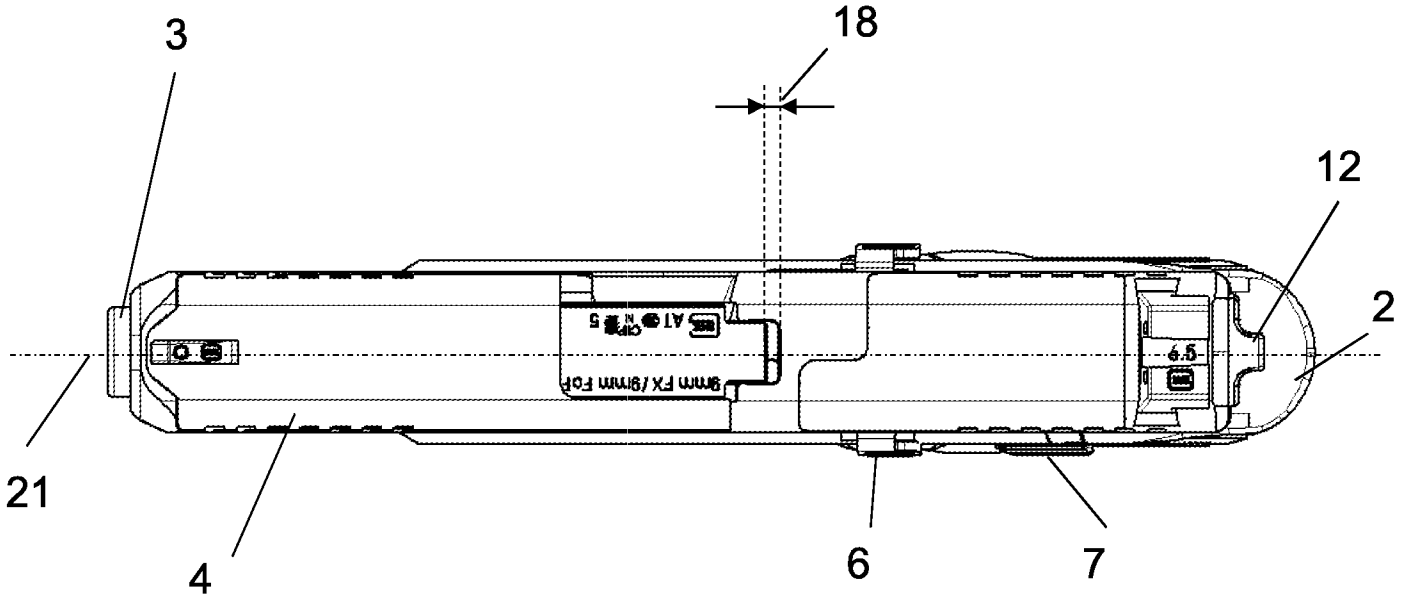
FIG. 2 is a plan view of the assembled training pistol of FIG. 1.

FIG. 2 is a plan view of the pistol in the assembled state, possibly ready to fire (when loaded). The following can be seen or are provided with reference signs: the frame 2, the cover plate 12, a slide lock 7, the slide 4 and the barrel 3. A clearance, also referred to as an unlocking gap, denoted by the reference sign 18 is clearly visible substantially in the direction of the barrel axis 21 between the rear front surface of the barrel 3 and the end face of the slide 4. The function of this clearance 18 is explained below.

Figure 4:
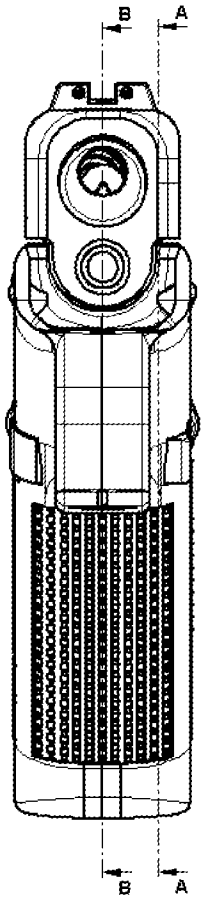
FIG. 4 shows the pistol of FIG. 3 in a front elevation view.
Figure 3:
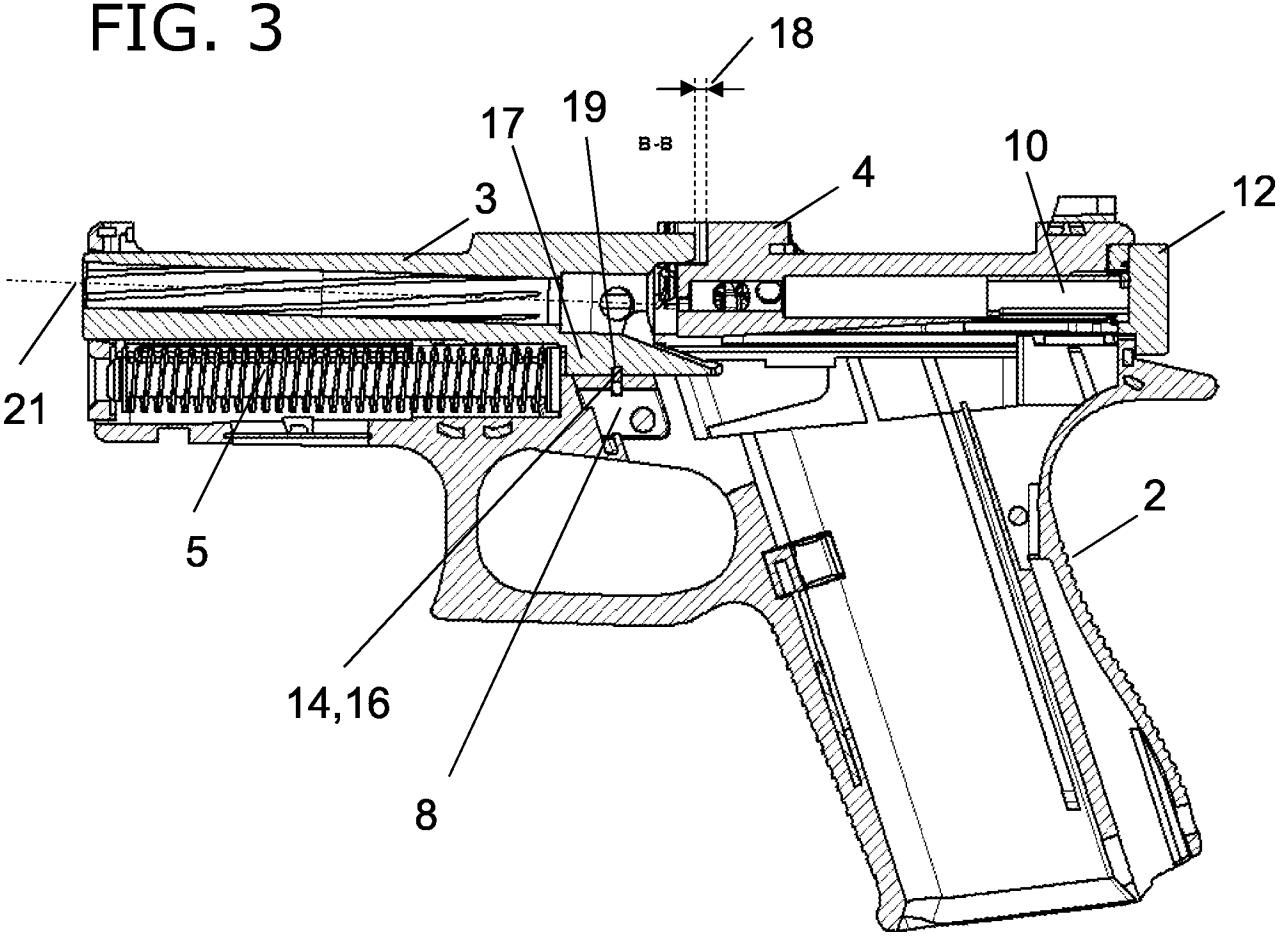
FIG. 3 shows the pistol of FIG. 2 in a section B-B as shown in FIG. 4.

FIG. 3 is a section through the central plane (in the normal position, the vertical plane through the barrel axis 21), corresponding to the line B-B of FIG. 4. The barrel 3, which is held firmly in the locking block 8 and with respect to the frame 2 by means of a locking device 14, is clearly visible. In this case, the locking device 14 engages in a locking device seat 19, preferably a groove on the barrel base 17 that extends perpendicularly with respect to the barrel axis 21. In the embodiment shown, the locking block 8 is fitted in the frame 2, which functions as a receptacle for the barrel base 17. The clearance 18 or disassembly gap can again be seen in the region of the reference line to reference number 4. The cover plate 12 of the firing pin assembly 10 is shown in the rearmost region of the pistol.

As indicated in FIG. 2 or FIG. 3, an unlocking gap 18 is provided, which has no disadvantageous effect during firing, since the bottom of a cartridge rests against the blowback system and the cartridge case seals the cartridge chamber in the barrel direction. This design of the unlocking gap 18, the slide 4 and the locking device 14 can be determined relatively easily by a person having ordinary skill in the art with knowledge of the invention depending on a few parameters, such as caliber and the associated gas pressures. As a rule of thumb, clearance dimensions in the range of from 0.5 to approximately 4.0 mm, preferably 0.8 to approximately 3.5 mm, particularly preferably 1.0 to 3.0 mm, can be assumed.

Figure 6:
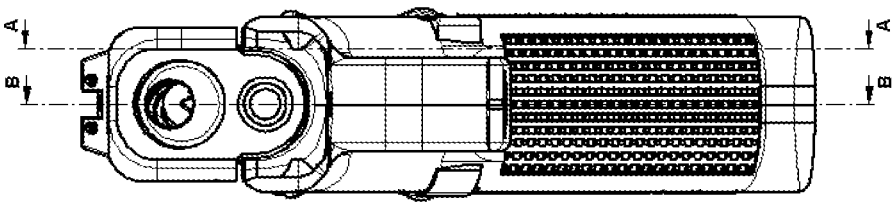
FIG. 6 shows the pistol of FIG. 5 in a front elevation view.
Figure 5:
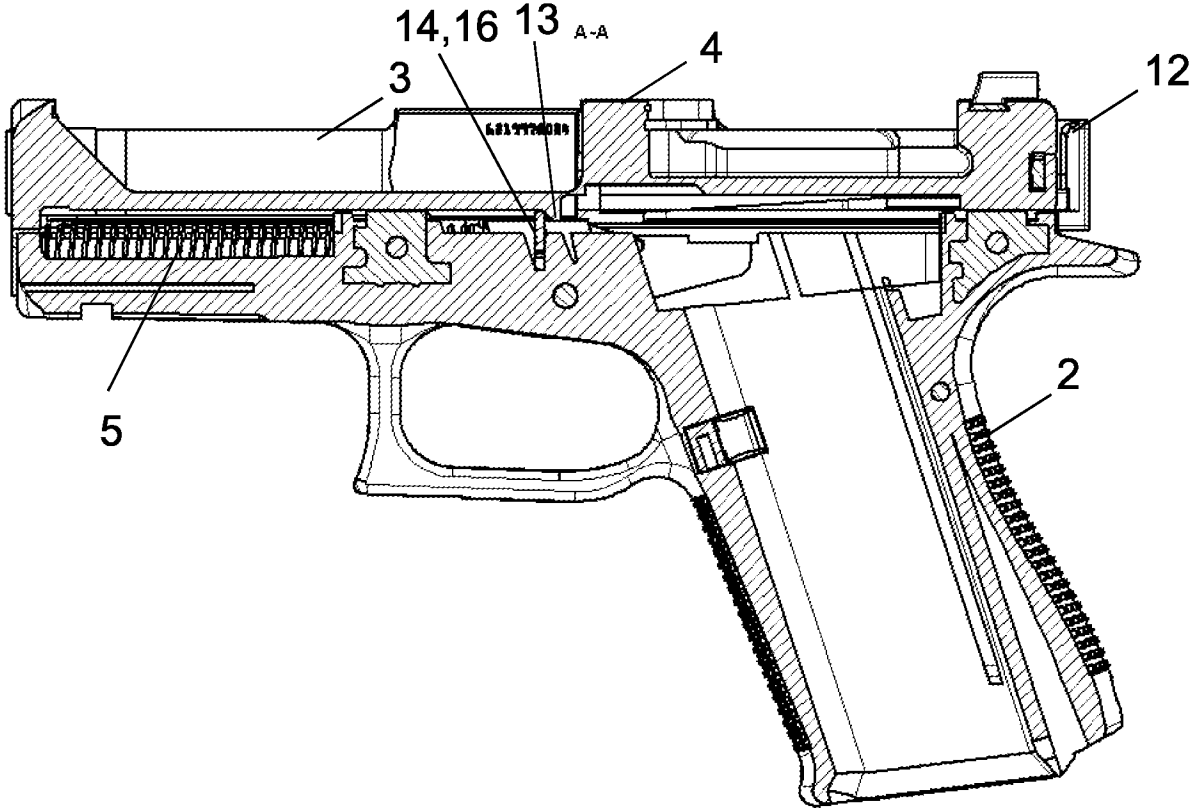
FIG. 5 shows the pistol of FIG. 2 in a section A-A as shown in FIG. 4 or FIG. 6.
Figure 8:
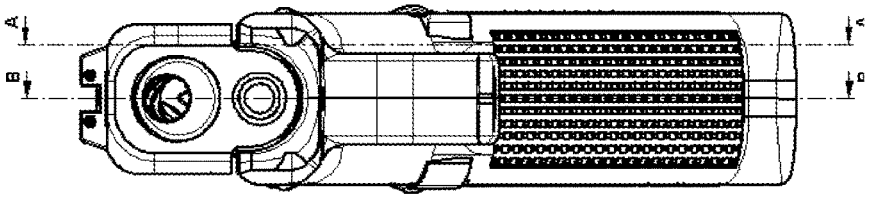
FIG. 8 shows the pistol of FIG. 7 in a front elevation view.

FIG. 5 is a section through the pistol along the line A-A of FIG. 4 and FIG. 6 and shown in the same state as FIG. 3. It is essential that a ramp 13, also referred to as a cam, is arranged at the front (local) end of the slide 4 in order to be able to interact with the rear end of the locking device 14 during an intended forward movement of the slide 4. The design of this (almost) contact point is the only position between the slide 4 and the barrel 3 at which (almost) no clearance 18 is present; the reason for this is explained further below.

Figure 7:
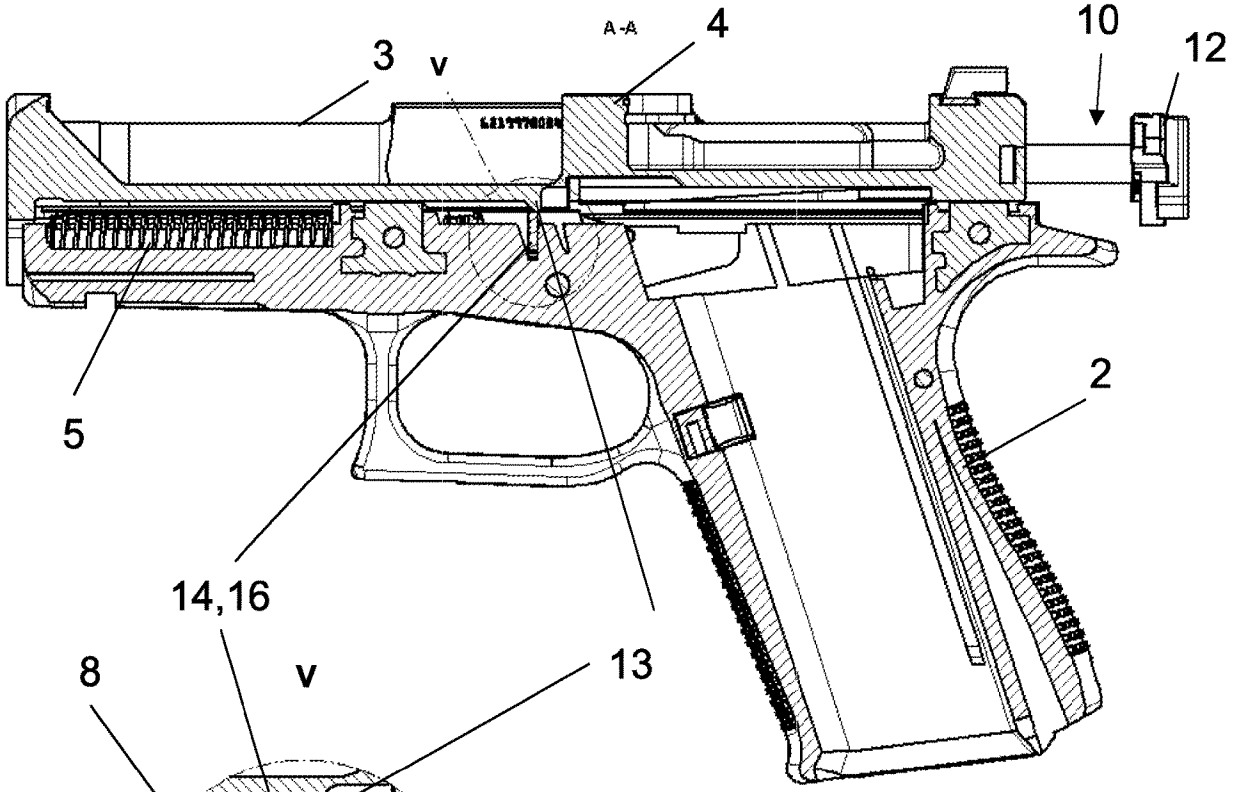
FIG. 7 shows the pistol of FIG. 2 in a section A-A as shown in FIG. 4 or FIG. 8 with the cover plate pulled out.
Figure 9:
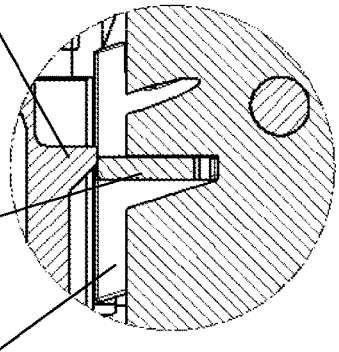
FIG. 9 shows the detail V of FIG. 7.
Figure 10:
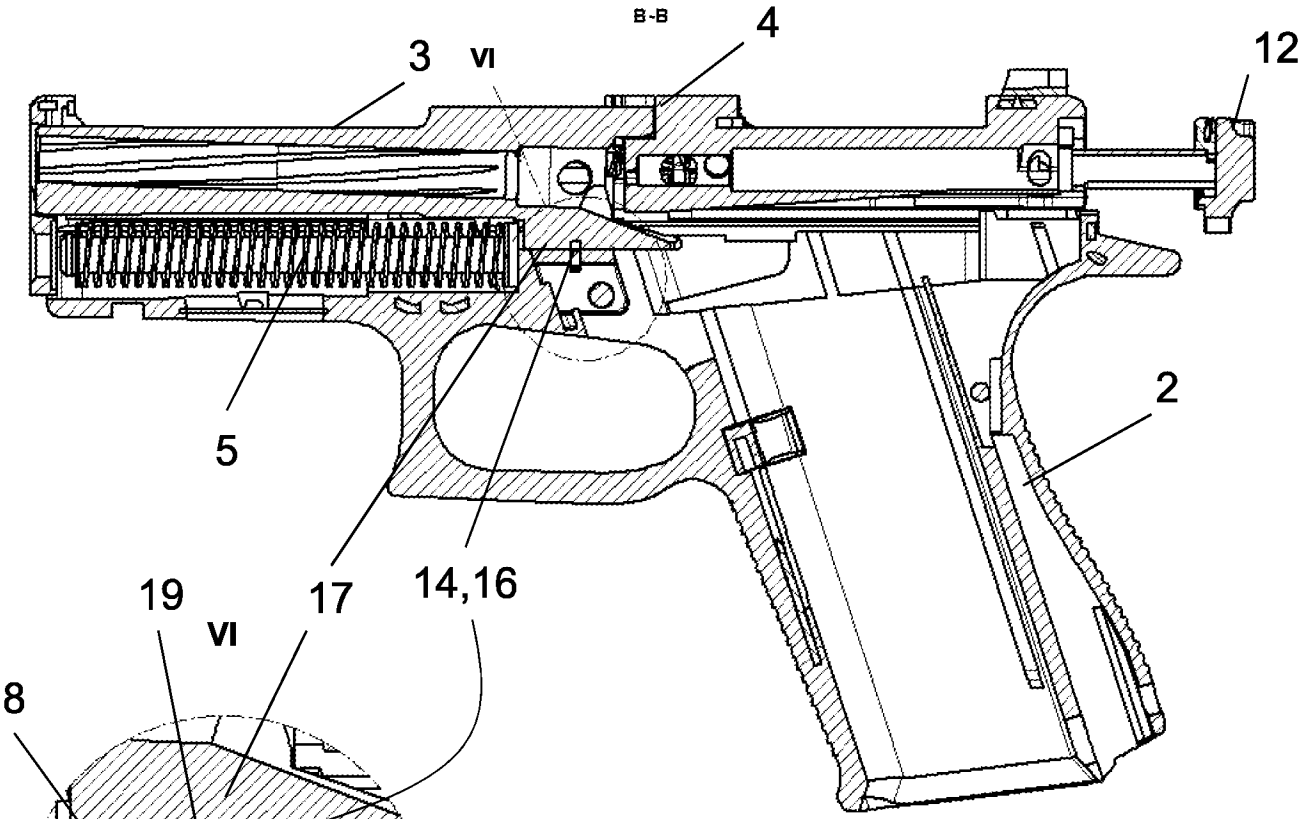
FIG. 10 shows the pistol of FIG. 2 in a section B-B as shown in FIG. 4 with the cover plate pulled out.
Figure 11:
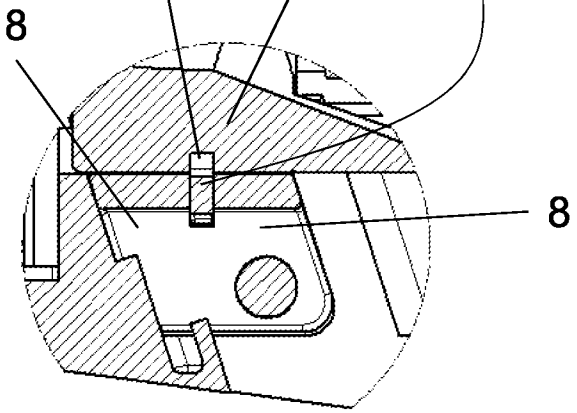
FIG. 11 shows the detail VI of FIG. 10 with a locking device designed as a locking platelet.

FIG. 7 is a section corresponding to FIG. 5, but with the cover plate 12 pulled out, including the firing pin assembly 10, and (not visible in the section) the slide lock 7 in the disassembly position. In this position, a slight forward movement to the extent of the unlocking gap 18 (see FIG. 2) is possible, for which reason the slide 4 in FIG. 7 is shown slightly pushed forward in relation to the closure position in FIG. 5. As a result, the locking device 14 can be unlocked according to the invention. It can be seen clearly, in particular in the enlarged detail V (FIG. 9), that the ramp 13 of the slide 4 presses the locking device 14, in this case in the form of a locking platelet 16 for example, downward counter to the force of a spring, as a result of which in the region of the central plane, shown in FIGS. 10 and 11, the locking device 14 comes out of the region of the locking device seat 19 or the groove of the barrel 3, more precisely the barrel base 17, and thus releases said barrel for further forward movement.

Figure 12:
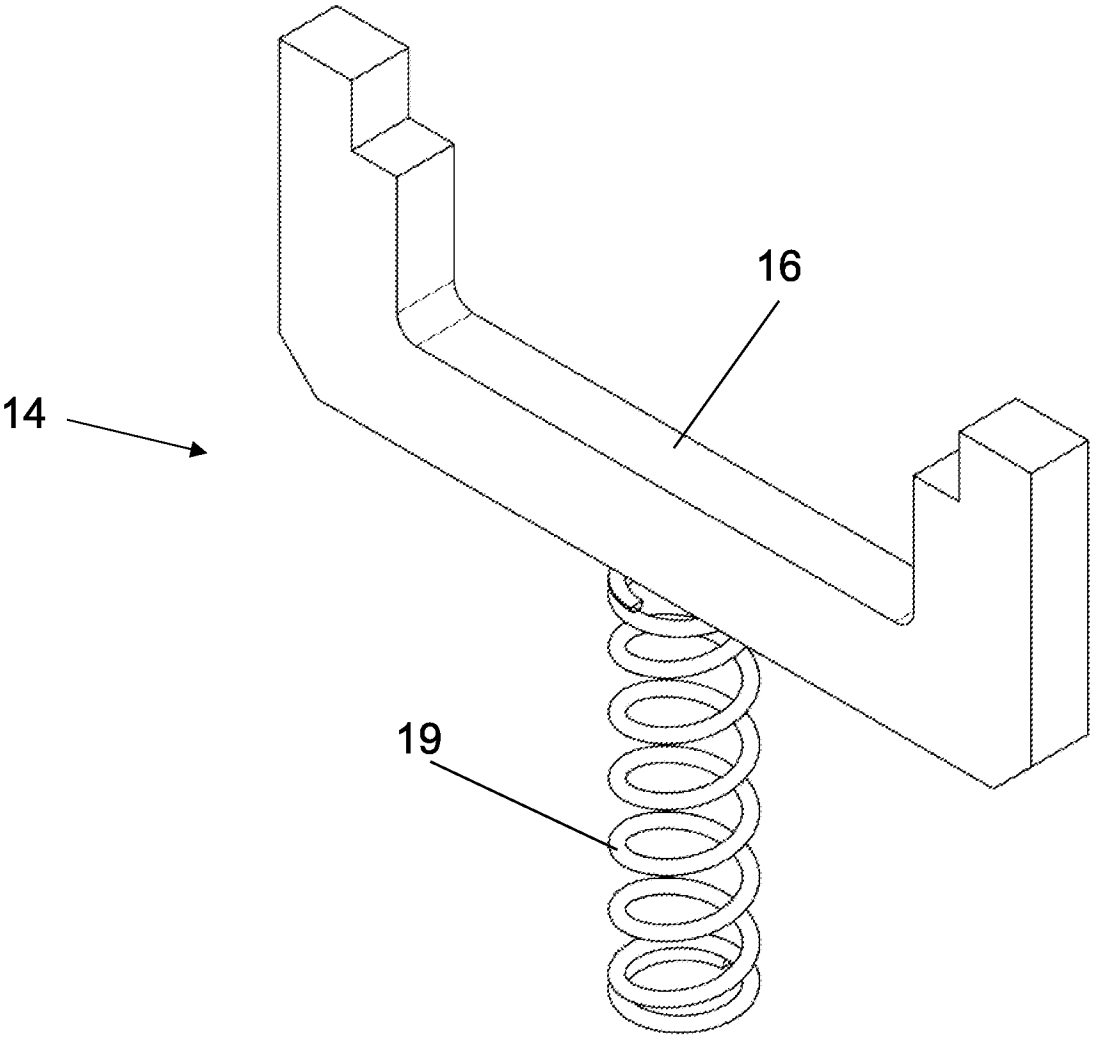
FIG. 12 is a schematic illustration of a locking device as a spring-loaded locking platelet.
Figure 14:
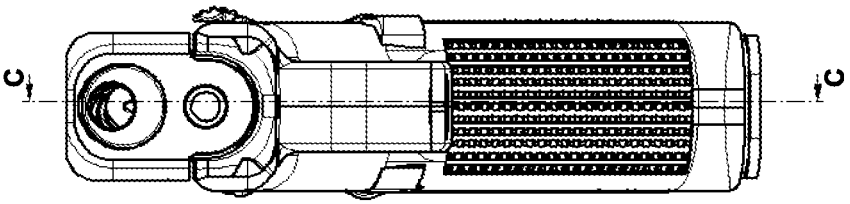
FIG. 14 shows the pistol of FIG. 13 in a front elevation view.
Figure 13:
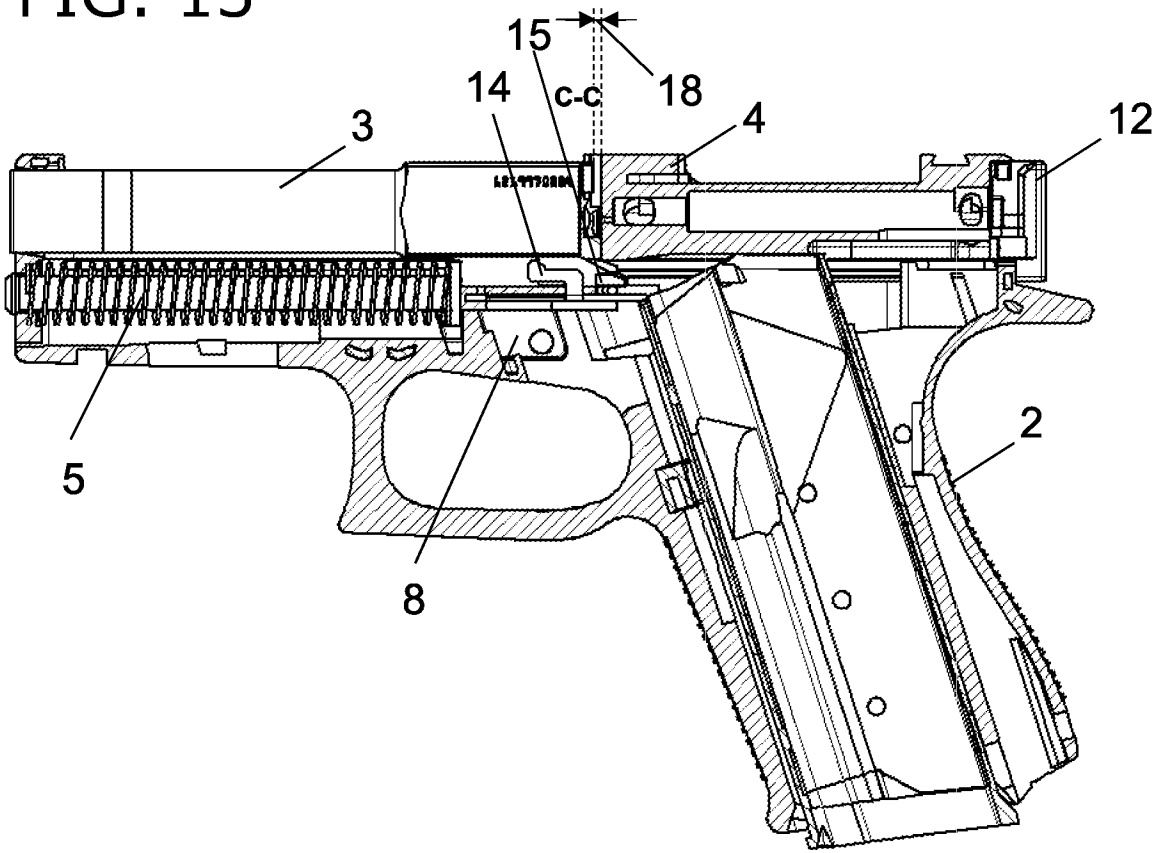
FIG. 13 shows a variant in a view corresponding to that of FIG. 4 or the section C-C of FIG. 14.
Figure 16:
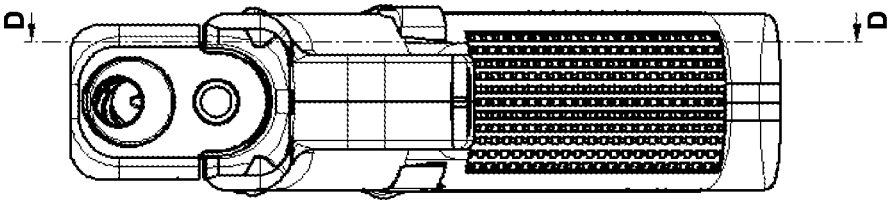
FIG. 16 shows the pistol of FIG. 15 in a front elevation view.
Figure 15:
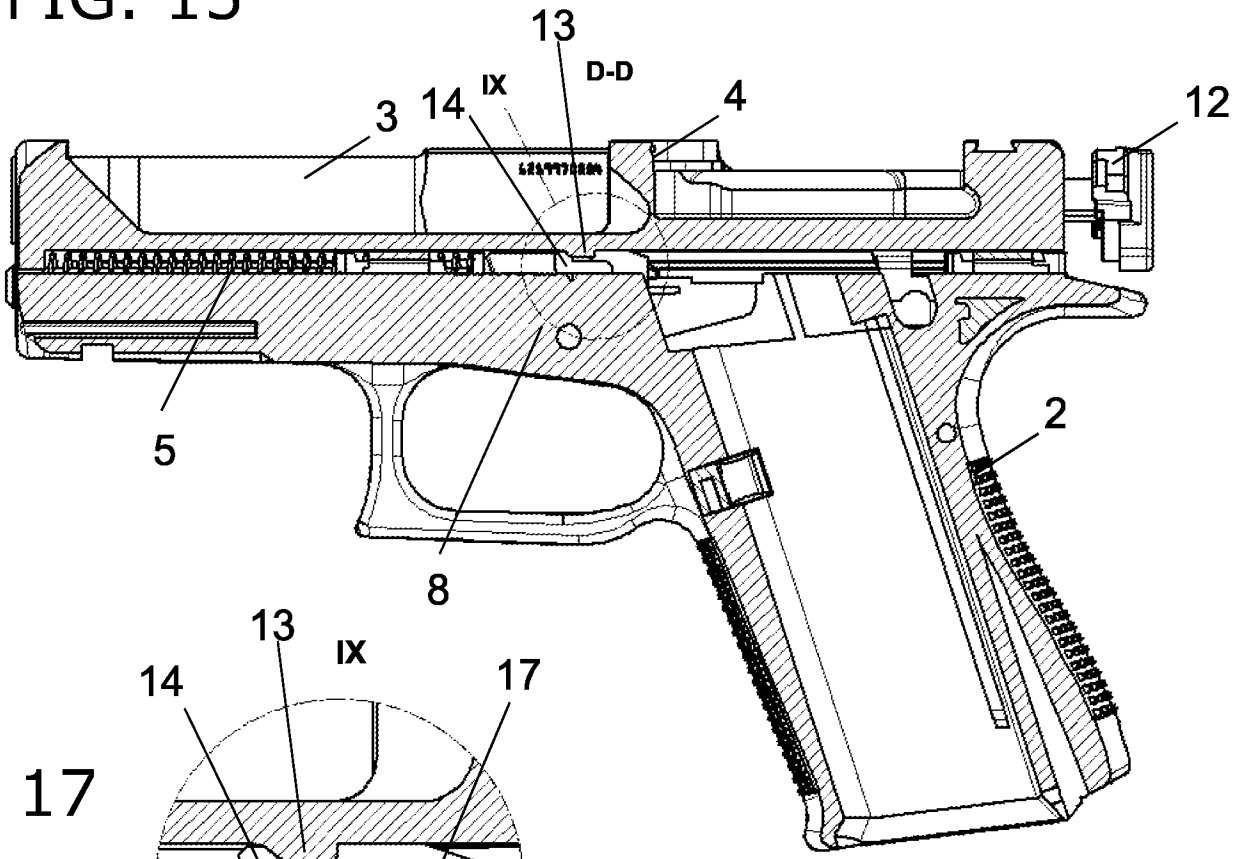
FIG. 15 shows the pistol of FIG. 13 in section D-D as shown in FIG. 14.
Figure 17:
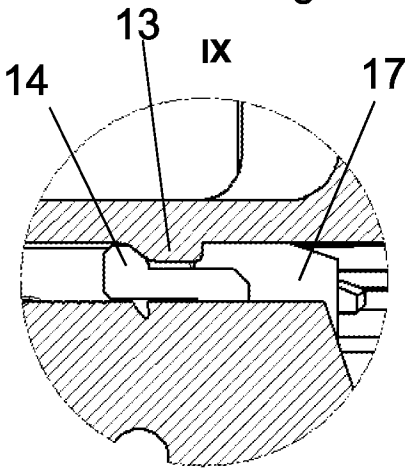
FIG. 17 shows the detail IX of FIG. 15.
Figure 19:
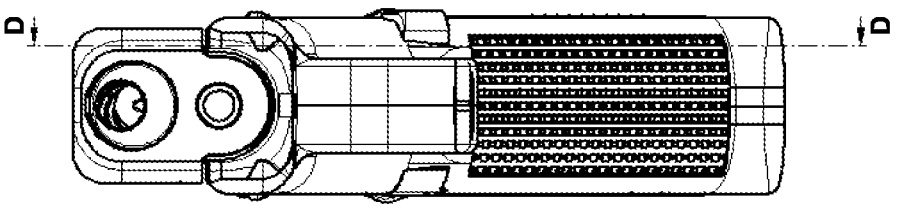
FIG. 19 shows the pistol of FIG. 18 in a front elevation view.
Figure 18:
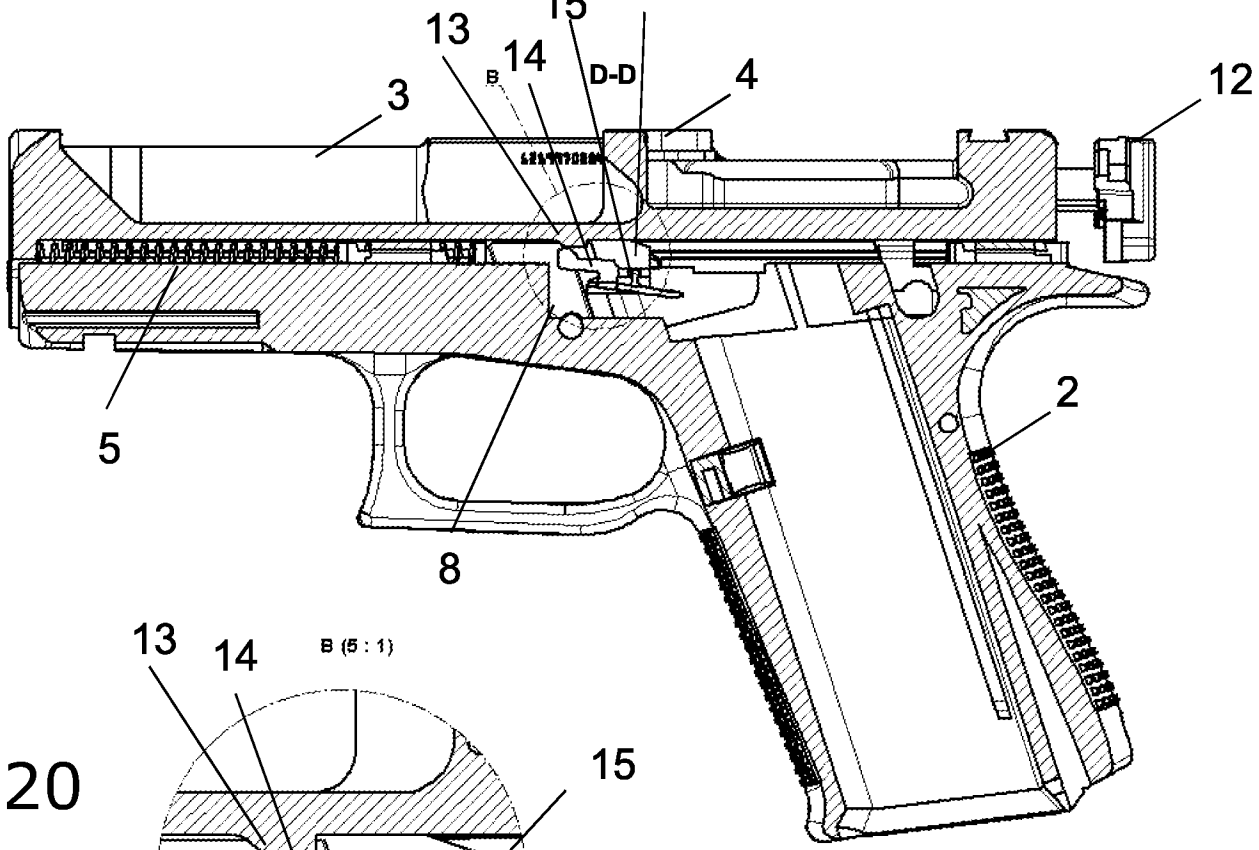
FIG. 18 shows the pistol of FIG. 15 in the same view but in a different disassembly state.
Figure 20:
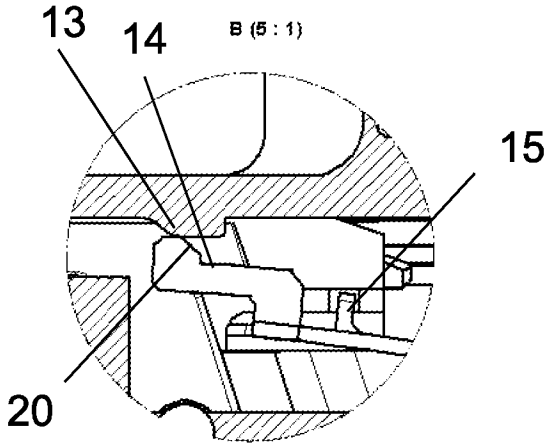
FIG. 20 shows the detail B of FIG. 18.

FIG. 12 shows an embodiment of a locking device 14 in a perspective view in the form of a U-shaped locking platelet having a purely schematic spring 19 which is inserted into a blind hole in the locking block 8. Alternatively, a bow spring or the like, which is located e.g. in a groove in the locking block 8, can be used. Due to the preferably symmetrical shape of the locking platelet 16, the locking device 14 can be actuated on both sides and at the same time by ramps 13 provided on both sides of the slide 4, which allows a highly symmetrical introduction of force.

Figure 21:
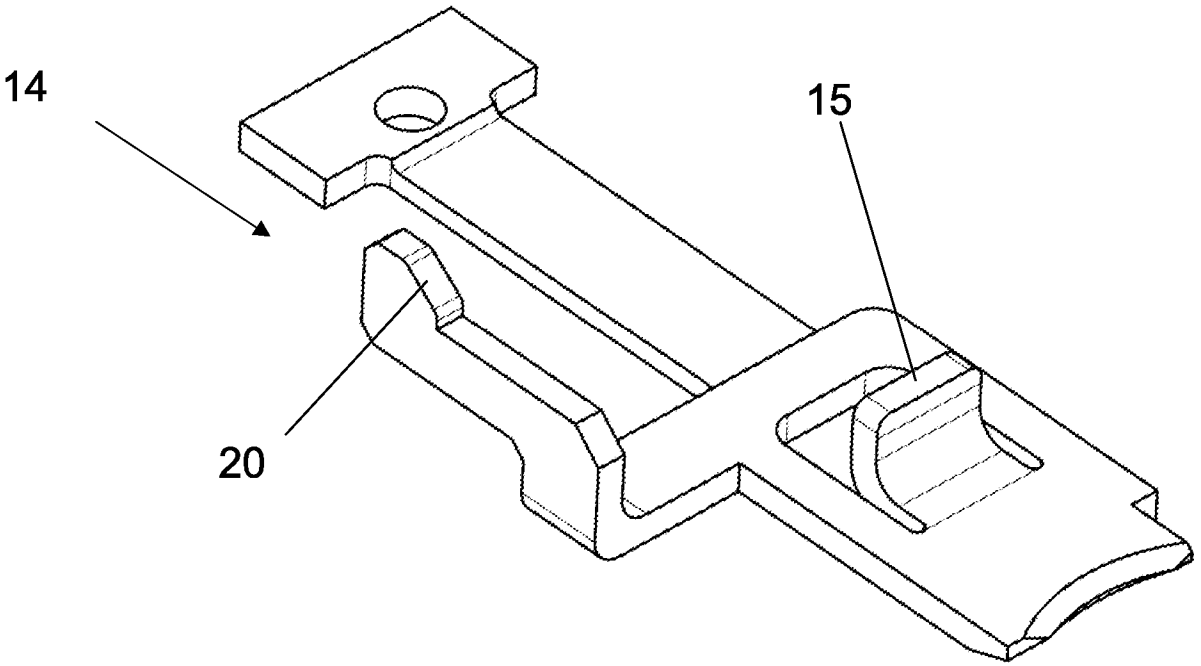
FIG. 21 shows an example of a one-piece locking device having a locking nose.

FIGS. 13-21 show a variant in which the locking device 14, shown in perspective in FIG. 21, is designed in one piece as a spring body having an integrally formed counter ramp 20 and locking nose 15. The locking nose 15 can also be interpreted as a catch or tongue which is provided for engaging in the locking device seat 19 of the barrel base 17. The hole in the locking device 14 without a reference sign is used for fixing in the pistol, preferably on the frame 2. A second counter ramp 20 can be formed symmetrically with respect to the central plane of the weapon in order to avoid transverse forces and moments about the vertical axis in cooperation with the ramp 13 of the slide. This locking device 14 does not require an extra spring; it is elastically deformed during the forward movement of the slide, together with the relatively large longitudinal extent and the narrow design between the fastening part and the locking nose 15. Overcoming the unlocking gap 18 highlighted in FIG. 13, as well as allowing the forward movement of the slide 4 with the barrel 3, is therefore substantially analogous to the movement sequence as in the description of FIGS. 5-11, to which reference is made here.

The assembly situation and the deformation of the locking device 14 can be clearly seen from FIGS. 13-20, which correspond to FIGS. 5-11; further explanation is not necessary.

It is easily conceivable that the locking device 14 may be slightly sloped in the contact region of the unlocking ramp (s) 13 in order to ensure a gentler introduction of force. In addition, it is particularly advantageous for these contact regions or counter ramps 20 to be formed on both sides of the central plane of the weapon and have the same angular position.

It has been shown that the production of the locking device 14, i.e. the locking platelet 16 and/or the one-piece locking device 14 having the locking nose 15, by means of punching and the subsequent bending process (or a combination of both) is particularly advantageous, since the strengths that can be achieved due to the bending process allow a small wall thickness of the locking device 14.

In the description and the claims, the terms "front," "back/behind," "above," "below" and so on are used in the generally accepted form and with reference to the object in its usual use position. This means that in a weapon the mouth of the barrel is "at the front," that the slide is moved "backward" by the explosive gas, etc. For vehicles, "front" is the usual direction of travel. "Barrel direction" is the direction of the barrel axis; perpendicular thereto substantially means a direction rotated by 90° thereto.

It should also be noted that in the description and the claims, terms such as the "lower region" of a suspension, reactor, filter, structure, or device or, more generally, an object refer to the lower half and in particular the lower quarter of the overall height; "lowermost region" refers to the lowermost quarter and in particular an even smaller part, while "central region" refers to the central third of the overall height (width–length). All these terms have their generally accepted meaning, applied to the intended position of the object under consideration.

In the description and the claims, "substantially" means a deviation of up to 10% of the stated value, if physically possible, both downward and upward, otherwise only in the appropriate direction; in the case of degrees (angle and temperature), this means±10°.

All given quantities and percentages, in particular those relating to the limitation of the invention, insofar as they do not relate to specific examples, are understood to have a tolerance of ±10%, e.g. 11% means 9.9% to 12.1%. With terms such as "a solvent," the word "a" is not to be considered to represent a singular numeral, but rather is to be considered an indefinite article or pronoun, unless the context indicates otherwise.

The terms "combination" and "combinations," unless otherwise stated, mean all types of combinations, starting from two of the relevant components up to a plurality or all of such components; the term "containing" also means "consisting of."

The features and variants stated in the individual embodiments and examples can easily be combined with those of the other examples and embodiments and in particular can be used for characterizing the invention in the claims without necessarily including the other details of the particular embodiment or of the particular example.

LIST OF REFERENCE SIGNS

1 Pistol
2 Frame
3 Barrel
4 Slide
5 Recoil spring assembly
6 Slide stop lever
7 Slide lock
8 Locking block
9 Frame rails
10 Firing pin assembly
11 Firing pin
12 Cover plate
13 Ramp/cam
14 Locking device
15 Locking nose/catch/tongue
16 Locking platelet
17 Barrel base
18 Clearance or unlocking gap
19 Locking device seat
20 Counter ramp
21 Barrel axis

The invention claimed is:

1. A training pistol having a rigid barrel with a barrel axis and configured with a conventional blowback system, comprising:

a frame including a magazine well for a magazine, a slide, and a barrel; the frame further comprising:
a slide stop lever;
a firing pin assembly having a cover plate that can be pulled out backward in the direction of the barrel axis;

wherein the frame further comprises a slide lock that can be moved between a holding position and a disassembly position; wherein
when the slide lock is in the holding position the slide lock limits the forward movement of the slide from a stopped position, and when the slide lock is in the disassembly position the slide lock permits a forward movement of the slide; and
the movement of the slide lock into the disassembly position is only possible when there is no magazine in the magazine well of the frame and the slide is in its stopped position;
the barrel is fastened in the frame by a locking device that can be moved against a counter force from a locking position, in which the locking device locks the barrel, to a release position, in which the locking device releases the barrel; and
an unlocking gap is defined between the barrel and the slide substantially in a direction of the barrel axis, such that after the slide lock is moved into the disassembly position and the unlocking gap is overcome, an unlocking ramp provided on the slide forces the locking device into the release position.

2. The training pistol of claim 1, wherein the locking device can be moved against a counter force that is created by a spring or by elastic deformation.

3. The training pistol of claim 1, wherein the slide includes two unlocking ramps that are arranged on the slide symmetrically with respect to a central plane of the pistol.

4. The training pistol of claim 1, wherein a region of the locking device that comes into contact with the unlocking ramp is a sloped region.

5. The training pistol of claim 4, wherein each sloped region of the locking device and the unlocking ramp that contacts that sloped region define the same angular position.

6. The training pistol of claim 1, wherein the locking device further comprises a locking nose that is configured to engage into a locking device seat on a base of the barrel.

7. The training pistol of claim 1, wherein the locking device is a stamped and bent part.

8. The training pistol of claim 1, wherein the unlocking gap has a width of between 0.5 to approximately 4.0 mm.

9. The training pistol of claim 1, wherein the unlocking gap has a width of between 0.8 to approximately 3.5 mm.

10. The training pistol of claim 1, wherein the unlocking gap has a width of between 1.0 to 3.0 mm.

* * * * *